US010914066B2

(12) United States Patent
Claeys

(10) Patent No.: US 10,914,066 B2
(45) Date of Patent: Feb. 9, 2021

(54) CURTAIN WALL

(71) Applicants: Stephanie Catharina R. Claeys, Zandhoven (BE); Laurens Leonard J. Claeys, Zandhoven (BE); Nausikaa Els P. Claeys, Zandhoven (BE)

(72) Inventor: Eric Claeys, Zandhoven (BE)

(73) Assignees: Stephanie Catharina R. Claeys, Zandhoven (BE); Laurens Leonard J. Claeys, Zandhoven (BE); Nausikaa Els P. Claeys, Zandhoven (BE)

( * ) Notice: Subject to any disclaimer, the term of this patent is extended or adjusted under 35 U.S.C. 154(b) by 0 days.

(21) Appl. No.: 16/302,169

(22) PCT Filed: May 2, 2017

(86) PCT No.: PCT/BE2017/000026

§ 371 (c)(1),
(2) Date: Nov. 16, 2018

(87) PCT Pub. No.: WO2017/201588

PCT Pub. Date: Nov. 30, 2017

(65) Prior Publication Data

US 2019/0136523 A1 May 9, 2019

(30) Foreign Application Priority Data

May 24, 2016 (BE) ..... 2016/5377

(51) Int. Cl.
*E04B 2/88* (2006.01)
*E04B 2/96* (2006.01)

(52) U.S. Cl.
CPC ..... *E04B 2/965* (2013.01); *E04B 2/88* (2013.01); *E04B 2/96* (2013.01); *E04B 2/967* (2013.01)

(58) Field of Classification Search
CPC ... E04B 2/88; E04B 2/96; E04B 2/965; E04B 2/967
See application file for complete search history.

(56) References Cited

U.S. PATENT DOCUMENTS 2,963,126 A * 12/1960 Cudini ..... E04B 2/90 52/302.6
3,266,210 A * 8/1966 Grossman ..... E04B 2/96 52/690

(Continued)

FOREIGN PATENT DOCUMENTS

CL 201401909 7/2013
CL 201803325 11/2017

(Continued)

OTHER PUBLICATIONS

Translation of EP 0435748 provided by espacenet.com at: http://translationportal.epo.org/emtp/translate/?ACTION=description-retrieval&COUNTRY=EP&ENGINE=google&FORMAT=docdb&KIND=A1&LOCALE=en_EP&NUMBER=0435748&OPS=ops.epo.org/3.2&SRCLANG=FR&TRGLANG=en.*

(Continued)

*Primary Examiner* — Andrew J Triggs
(74) *Attorney, Agent, or Firm* — Bacon & Thomas, PLLC

(57) ABSTRACT

A curtain wall including one or more mullion profiles and one or more transom profiles, where the one or more mullion profiles extend vertically, the one or more transom profiles are attached horizontal between two mullion profiles. A barrier for water is provided on the fixing points of the transom profiles to the mullion profiles, where the barrier is adapted to divert this water to a the transom profile, where the transom profiles is adapted to drain this water to the outside of the curtain wall.

20 Claims, 13 Drawing Sheets

(56) References Cited

U.S. PATENT DOCUMENTS

| | | | | | |
|---|---|---|---|---|---|
| 3,866,369 | A * | 2/1975 | Paull | E06B 1/702 | 52/209 |
| 4,055,923 | A * | 11/1977 | Biebuyck | E04B 2/96 | 52/235 |
| 4,584,804 | A | 4/1986 | Tajima | | |
| 4,638,613 | A | 1/1987 | Tonsmann | | |
| 5,067,293 | A * | 11/1991 | Reynolds | E04B 2/88 | 52/235 |
| 5,452,552 | A * | 9/1995 | Ting | E06B 7/14 | 52/235 |
| 5,598,671 | A | 2/1997 | Ting | | |
| 5,839,236 | A * | 11/1998 | Frey | E04B 2/965 | 52/235 |
| 6,804,920 | B2 * | 10/2004 | Hogan | E04B 2/96 | 52/204.5 |
| 6,807,779 | B1 | 10/2004 | Hocker et al. | | |
| 8,015,764 | B2 * | 9/2011 | Yun | E06B 7/14 | 52/209 |
| 9,567,746 | B1 * | 2/2017 | Barbulescu | H02G 3/388 | |
| 2004/0045235 | A1 * | 3/2004 | Ley | E04B 2/965 | 52/235 |
| 2006/0201084 | A1 * | 9/2006 | Arias | E04B 2/965 | 52/235 |
| 2013/0180189 | A1 * | 7/2013 | Reifer | E04B 2/967 | 52/204.593 |
| 2015/0135615 | A1 | 5/2015 | Hogan et al. | | |
| 2016/0237682 | A1 * | 8/2016 | Stronks | E04B 2/965 | |

FOREIGN PATENT DOCUMENTS

| | | | |
|---|---|---|---|
| CL | 201803328 | | 11/2017 |
| CN | 1181120 | A | 5/1998 |
| CN | 1452680 | A | 10/2003 |
| CN | 101137804 | A | 3/2008 |
| DE | 3313444 | A1 | 11/1983 |
| EP | 0050838 | A1 | 5/1982 |
| EP | 0435748 | A1 | 7/1991 |
| FR | 1331074 | | 5/1963 |
| GB | 2123052 | B | 1/1984 |
| GB | 2143558 | A | 2/1985 |
| WO | 0181686 | A1 | 11/2001 |
| WO | 2006094394 | A1 | 9/2006 |
| WO | 2017/201588 | A | 11/2017 |
| WO | 2017/201589 | A | 11/2017 |
| YU | 44703 | A | 11/2004 |

OTHER PUBLICATIONS

International Search Report in related PCT/BE2017/000026, dated Oct. 24, 2017.

Written Opinion in related PCT/BE2017/000026, dated Oct. 24, 2017.

International Preliminary Report on Patentability in related PCT/BE2017/000026, dated Aug. 31, 2018.

Belgium Search Report in related Belgium Application No. 201605377, dated Nov. 25, 2016.

Chilean Examiner Report in corresponding Chilean Application No. 201803326, dated Apr. 13, 2020.

Chilean Search Report in corresponding Chilean Application No. 201803326, dated Apr. 13, 2020.

Chinese Office Action in corresponding Chinese Application No. 2017800322810, dated Apr. 15, 2020.

Columbian Office Action in corresponding Columbian Application No. NC2018/0013813, dated Apr. 1, 2020.

Eurasian Office Action in corresponding Eurasian Application No. 201892719, dated Dec. 11, 2019.

Singapore Written Opinion in corresponding Singapore Application No. 11201810168U, dated Feb. 3, 2020.

Eurasian Office Action in corresponding Eurasian Application No. 201892719, dated Sep. 15, 2020.

* cited by examiner

CURTAIN WALL

BACKGROUND OF THE INVENTION

1. Field of the Invention

The present invention relates to a curtain wall.

This is a structure comprising of mullion profiles and transom profiles that defines openings in which panels, usually glass panels, but closed panels are also possible, are placed to form a non-load-bearing outer wall.

A disadvantage of the known curtain walls is related to the drainage of water.

Due to various causes, such as wind pressure, curtain wall movements and imperfections in the seals, small quantities of rainwater can occur into the profiles. This is not harmful as such, as long as this water is evacuated to the outside and does not seep through to the inside of the curtain wall.

To this end, the known curtain walls are made with passages and surfaces that drain the water laterally to the mullion profiles, the water being collected in the mullion profiles and passing down the mullion profiles. At certain defined vertical distances, corresponding to more than one height of the panels, or even only at the base, the mullions are provided with a water drain to the outside.

This has two main disadvantages: Such drains with their corresponding parts in the mullion profiles to guide the water to the drains, increase the number of components that have to be pre-made and which must be fitted during the installation of the curtain wall and thereby increase the cost of the curtain wall.

Furthermore, they have the disadvantage that, should a leak occur inside, it is not clear at all where, that is to say at which panel, the cause of the leak must be sought. After all, the water can come from any point above that particular panel.

This means that a relatively large part of the curtain wall must be dismantled in order to find and solve the leak. Since with the known curtain walls this has to be done from the outside and often at considerable height, this is not easily done.

With classic curtain walls, the mullions and transoms are constructed in multiple parts with an inner part and an outer part, between which the edges of the glass panels are caught, and which are connected to each other during the construction of a curtain wall, each time a glass panel is inserted, both parts are pulled towards each other by means of screws or the like, thus clamping the said edges of the glass panels between seals provided on the parts.

2. Related Art

Examples of such classic curtain walls are described in GB 2.143.558 and in DE 3.313.444.

With such classic curtain walls, the construction is completely done from the outside, providing sufficient manoeuvring space during construction to allow for all kinds of complex seals to be placed from the outside, such as a continuous horizontal seal in the case of GB 2.143.558 or a complex seal in the case of the DE 3.313.444, which incidentally does not prevent water from the transoms from falling into the mullions.

A disadvantage is that the construction must be done from the outside, thus requiring scaffolding and powerful lifting equipment and must be subject to severe safety measures.

Due to the working conditions outside, the work is often done with less accuracy and mistakes can easily occur, resulting in leaks.

SUMMARY OF THE DISCLOSURE

The present invention relates in particular to a type of curtain wall that allows said curtain wall to be built completely from the inside of a building, although construction from the outside is not excluded, and with this particular feature that in the entire structure of the curtain wall, not a single screw is used when building it. There are no screws required for connecting the outside shell with the inner shell, as it is a 1-piece thermally broken profile, and no screws are used for the placement of the horizontal transoms in the vertical mullions.

The object of the invention is to provide a solution to the aforementioned and other disadvantages, and to this end, the invention is a curtain wall of this type which comprises one or more mullion profiles and one or more transom profiles and panels that are fitted with their edges in the mullion profiles and in the transom profiles, wherein the one or more mullion profiles extending vertically are provided with an undercut groove, having a fixed width access opening on two opposite sides, which grooves form a rabbet in which the side edge of a said panel is fitted, wherein the one or more transom profiles extend horizontally between two mullion profiles and are fitted with their ends in the aforementioned grooves of these two mullion profiles, wherein these ends of the transom profiles are provided with a sealing piece that forms a barrier for water, wherein the barrier is adapted to divert this water to said transom profile and wherein the transom profiles are equipped to drain this water to the outside of the curtain wall.

For the sake of clarity, it is noted that such water infiltrates only in small quantities into the mullion profiles, an occurrence which is undesirable, but which in practice proves to be inevitable, and this water will of course flow down via the mullion profiles, should it occur on the mullion profiles.

Here, the outside of the curtain wall is the side exposed to the atmospheric influences.

The advantage is that no water drains must be installed in the mullion profiles, but that any infiltrated water in the curtain wall can be evacuated at each panel, as opposed to traditional curtain walls, where infiltrated water is collected across multiple panels in the mullions and then evacuated.

This also results in a vertical and horizontal seal of the mullion profiles for each panel, thus assuring that, should a water leak occur, the problem can be pinpointed with respect to the placement of that particular panel or to the mullion profiles or transom profiles around that particular panel, making the finding and solving of a problem much easier.

While in the traditional curtain walls water is fed from the transom profiles to the mullion profiles and drained from there, the curtain wall according to the present invention is designed to guide water from the mullion profiles from each panel separately to the transom profiles and to drain the water from there.

Preferably, the transom profiles are arranged to drain said water to the outside of the curtain wall because the transom profiles, or a different profile attached to the transom profiles, such as for example a glass frame, are provided with drains for water to the outside, these drainage openings being located at a distance from the mullion profiles. Preferably this distance is between 10 and 300 mm.

In a further preferred embodiment, the transom profiles are designed in such a way that the portion of the transom profiles to which said water is diverted, is positioned horizontally or slantingly to the outside, wherein the transom profiles comprise a sub-profile made in one piece, wherein the sub-profile is part of said section to which said water is diverted and wherein the sub-profile is provided with an upright edge on the inside of said section.

The sub-profile is made out of a single piece of aluminium and is waterproof. Thanks to the upright edge, inward leakage is prevented, even if there is a small amount of water on the transom profiles, as long as this amount does not overflow the edge.

Such sealing barrier can be obtained by applying an elastic sealing kit to the ends of the transom profile into the groove of a connecting mullion profile.

However, it is preferred that the sealing barriers are formed by seals of flexible plastic or rubber, wherein the seals are applied to the ends of the transom profiles and wherein the shape of the mullion profiles and the seals are adapted to each other in order to obtain a watertight connection between the transom profiles and the mullion profiles at the aforementioned attachment points.

Such sealing pieces are a practical way of obtaining such a barrier, they are durable over time and can accommodate any possible small movement of the curtain wall.

The sealing pieces are preferably dimensioned to fully envelop an end of a transom profile.

Preferably, the sealing pieces (28, 29) are made in one piece.

However, it is not excluded that the sealing pieces are made of multiple parts, for example out of two pieces with a connected lower and an upper part, for example to facilitate the installation of the transom profiles and the sealing pieces, for example in the following two steps:

step 1: placing the transom profile with the lower part of the sealing piece in the mullion profile, or alternatively installing and attaching the lower part of the sealing piece into the groove of the mullion profile and then positioning the transom profile onto that;

step 2: after attaching the transom profile, attaching the upper part of the sealing piece, so that both parts of the sealing piece form a perfectly watertight connection in the groove of the mullion profile.

In all these cases, the principle of drainage of any infiltration water for each panel separately applies in contrast to the classic principle of drainage through the waterfall principle.

Preferably, the parts of the mullion profiles where the sealing pieces are located, and the sealing pieces, in horizontal cross-section, are rectangular in shape. This makes it easy to adjust the shapes of the mullion profiles' groove and the sealing pieces to form a waterproof connection and to easily install such barriers along with the transom profiles.

The sealing pieces have a complex upper surface, composed of a number of planes that slope downwards from the side with which the sealing pieces rest against the mullion profiles, towards the lowest point above a transom profile.

In a further preferred embodiment, the sealing pieces are provided with a deformable hollow chamber to facilitate the installation of transom profiles on which such sealing pieces are placed.

Through this deformable chamber, the sealing pieces can be deformed during the installation, making the installation easier, while the sealing pieces retain the desired shape after installation.

In a further preferred embodiment, a sealing piece is provided at each of the two ends of the transom profiles, with at least one and preferably exactly one of the sealing pieces of a transom profile being slidable on the transom profile, preferably over a distance of at least 1 and maximum 12 mm, to accommodate small movements.

Under the influence of wind and over time, small deformities can occur in the curtain wall. In order to ensure that these do not lead to high stress, which could lead to a breakage, said slidability is desirable.

In a further preferred embodiment, the sealing pieces comprise a flat end wall which is perpendicular to the profile direction of the transom profiles, wherein the end wall is completely closed in the profile direction of the transom profiles and rests against a mullion profile.

This prevents any infiltration water from flowing past the sealing pieces and seeping downwards.

In a further preferred embodiment, the curtain wall comprises mullion profiles, transom profiles and one or more panels, wherein the mullion profiles are provided on each side with a groove for clamping the side edge of a panel, wherein the grooves have an access opening, wherein the access opening has a first dimension in horizontal direction, wherein the transom profiles in the horizontal direction and at right angles to the profile direction of the transom profiles have a second dimension, wherein the second dimension is larger than the first dimension, wherein the transom profiles in a non-horizontal direction at right angles to the profile direction have a third dimension, wherein the third dimension is smaller than the first dimension.

In this embodiment, the mullion profiles are made of a single piece or of multiple connected non-detachable sub-profiles.

Such a curtain wall is easy to build without requiring many actions from the inside, because the aforementioned features allow the transom profiles to be placed in a groove around their longitudinal axis, and then to obtain their desired orientation simply by rotation and to be fixed in the grooves.

In yet another preferred embodiment, one or more walls of the grooves are provided with a recess in which a part of the transom profiles is located, the transom profiles being vertically supported by a bottom edge of said recess.

This is an easy way to attach the transom profiles to the mullion profiles without requiring further attachments. In addition, such a suspension allows the transom profiles in their profile direction to have some play, which is desirable to accommodate stress in the curtain wall.

In yet another preferred embodiment, the transom profiles are Z-profiles, with a first vertical leg directing upward and located on the inside of the transom profile, a second vertical leg directing downward and located on the outside of the transom profile, and a horizontal spacer section between the first and the second leg.

Due to the vertical legs, sufficient rigidity is obtained, while the horizontal spacer section allows sufficient space to install a panel above the transom profile.

In yet another preferred embodiment, the transom profiles are provided with an undercut groove which runs in the profile direction and with a rod fitted in the undercut groove, wherein the mullion profiles have a second groove for receiving the end of said rod projecting out from the undercut groove, thereby blocking any rotational movement of the transom profiles.

Such an arrangement prevents the transom profiles from being detached by rotation of the transom profiles.

In a still another preferred embodiment, said grooves on the different sides of the mullion profiles have a different depth.

This also allows the panels to be placed from the inside by shuffling a panel into the deepest groove, then shifting it into the desired orientation and then shuffling it towards the shallow groove.

In yet another preferred embodiment, the mullion profiles and the transom profiles are composite profiles, each composed of two or more sub-profiles, wherein the sub-profiles are not necessarily made of the same material.

This results in good thermal insulation, for example by working with an aluminium outer and inner sub-profile, connected by insulating plastic profiles.

Preferably the panels are glass panels.

In yet another preferred embodiment, the mullion profiles and the transom profiles define rectangular openings, wherein one or more panels are positioned in said openings to thus close these openings, wherein the one or more panels are secured by means of first glazing beads attached to the aforementioned mullion profile by means of first attachment aids, wherein the first attachment aids and the mullion profiles are designed to secure the first attachment aids, preferably by snapping them into place, to a said mullion profile, wherein the first attachment aids and the first glazing beads are adapted to secure the first glazing beads to the first attachment aids.

In this way, first glazing beads can be easily attached simply by snapping them into place. This allows the panels to be fitted from the inside.

This also allows greater freedom in the design of the mullion profiles, because the placement possibility for first glazing beads is already provided. The first attachment aids can already be attached prior to the installation of a panel, while a glazing bead can only be installed later, thus limiting the connection possibilities of a glazing bead directly to a mullion profile.

In yet another preferred embodiment, the first attachment aids are made of plastic and the first glazing beads are made of aluminium.

Costs can be saved by using first attachment aids in plastic, rather than in the relatively expensive aluminium.

In a further preferred embodiment, the first attachment aids and the aforementioned mullion profiles are designed to snap the first attachment aids into a said mullion profile in a direction perpendicular to the plane of the panel in question, wherein the first attachment aids and the first glazing beads are designed to snap the first glazing beads into the first attachment aids in a direction parallel to the plane of that particular panel.

In yet another preferred embodiment, the first attachment aids are profiles extending over only a portion of the length of the first glazing beads.

In yet another preferred embodiment, the first glazing beads are each secured to a mullion profile by a minimum of two first attachment aids that are placed some distance apart.

In yet another preferred embodiment, the one or more of the aforementioned mullion profiles and the first glazing beads are designed in such a way that the first glazing beads rest, with their side facing away from the panel in question, against the mullion profile.

In yet another preferred embodiment, one or more panels are secured by means of second glazing beads, that are attached to an aforementioned transom profile by means of second attachment aids, wherein the second attachment aids and one or more of said transom profiles are adapted to attach the second attachment aids to the transom profile, wherein the second attachment aids and the second glazing beads are designed to snap the second glazing beads into the second attachment aids.

The advantages mentioned with reference to the first glazing beads and the mullion profiles are therefore also applicable to the transom profiles and the second glazing beads.

In summary, it can be said that, thanks to the invention, the construction of a curtain wall can be realized, with the evacuation of possible infiltration water for each panel SEPARATELY, and not by the classically known waterfall principle.

The coupling, more specifically the connection, of the horizontal transom with the vertical mullion complies thus with three essential criteria required for a curtain wall, namely:

1/ allowance for tolerances due to production and/or assembly, which are de facto unavoidable;

2/ allowance for differential settling of the building and thermal dilatations, which are also de facto unavoidable;

3/ waterproofing between transom and mullion, which is essential with a curtain wall.

BRIEF DESCRIPTION OF THE DRAWINGS

With the intention of better showing the characteristics of the invention, a preferred configuration according to the present invention is described hereinafter by way of an example, without any limiting nature, with reference to the accompanying drawings, wherein:

FIGS. 2 and 3 schematically represent a cross-sectional view of the curtain wall of FIG. 1 taken along line II-II, in which parts are omitted for clarity's sake in both figures;

DETAILED DESCRIPTION OF PREFERRED EMBODIMENTS OF THE INVENTION

The curtain wall 1 shown in FIGS. 1 to 5 consists of a structure of vertical mullions 2 between which horizontal transoms 3 are attached. In the openings formed by the mullions 2 and the transoms 3, panels are placed, in this example, but not necessarily, glass panels 4, which are seated with their edges in the mullions 2 and the transoms 3.

Figure 6:
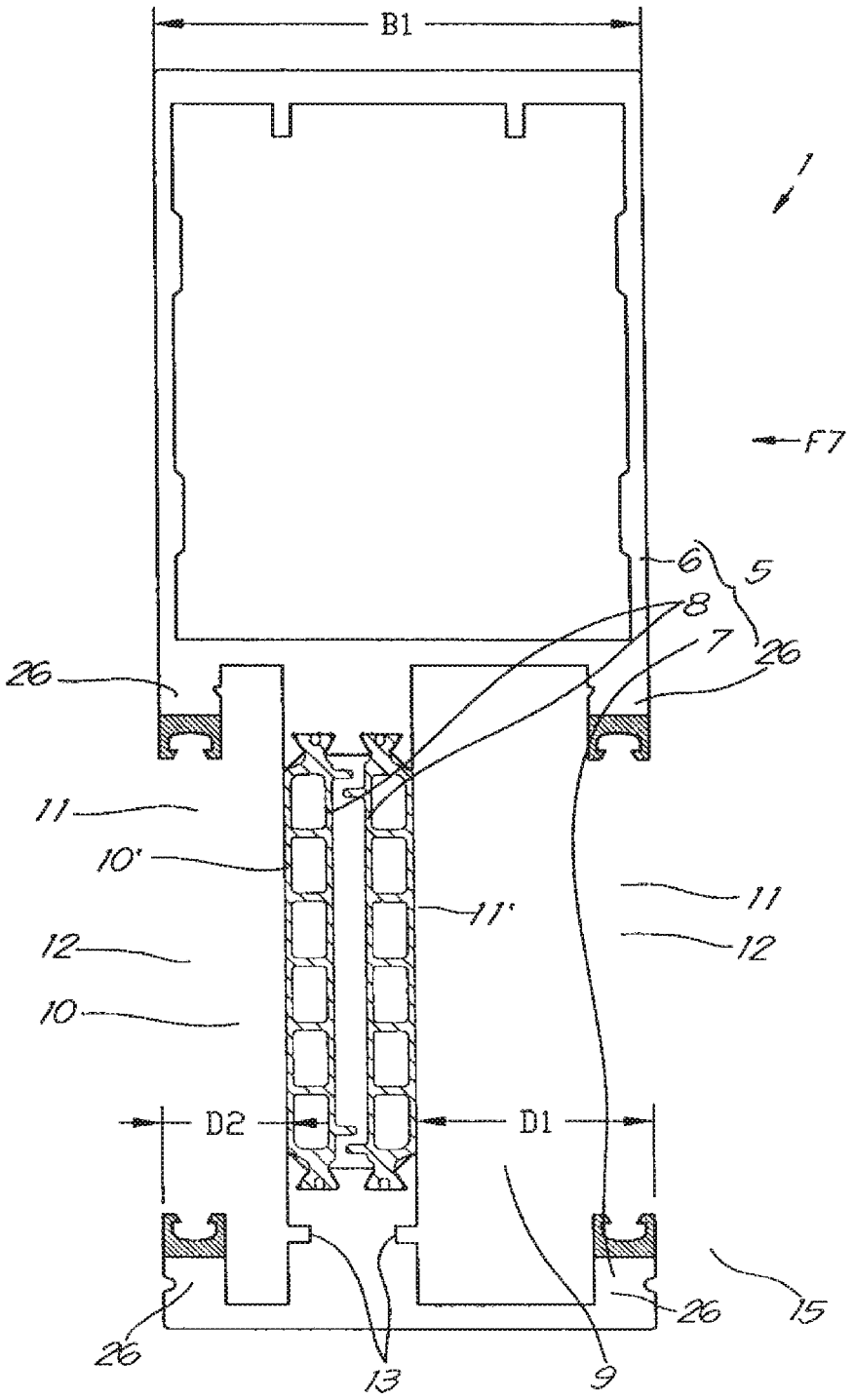
FIG. 6 schematically represents a part of the curtain wall of FIG. 1 and shows a step in the manufacturing procedure of the curtain wall of FIG. 1.

The mullions 2 are formed by mullion profiles 5 with a width B1 of 56 mm. The mullion profiles 5 are shown separately in a cross-sectional view in FIG. 6.

The vertical mullion profiles 5 consist of four sub-profiles, namely an aluminium tubular sub-profile 6 on the inside, an aluminium sub-profile 7 on the outside and two plastic insulation profiles 8. These four sub-profiles 6, 7, 8 are assembled into a monolithic entity by means of rolling, i.e. mechanical deformation of lips on the aluminium sub-profiles 6, 7 to clamp the plastic profiles 8.

Figure 1:
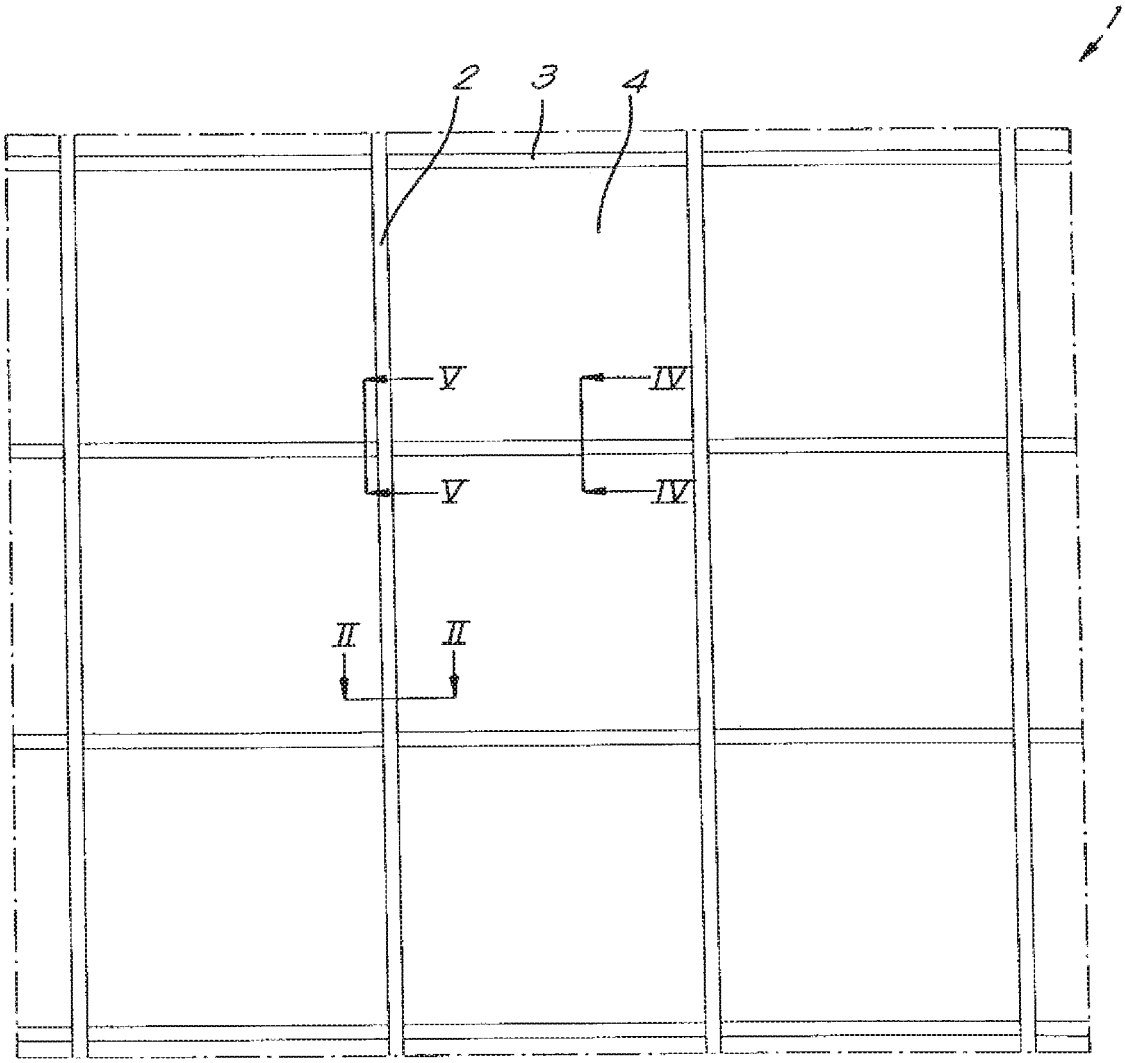
FIG. 1 schematically represents an outer view of a curtain wall according to the invention.
Figure 2:
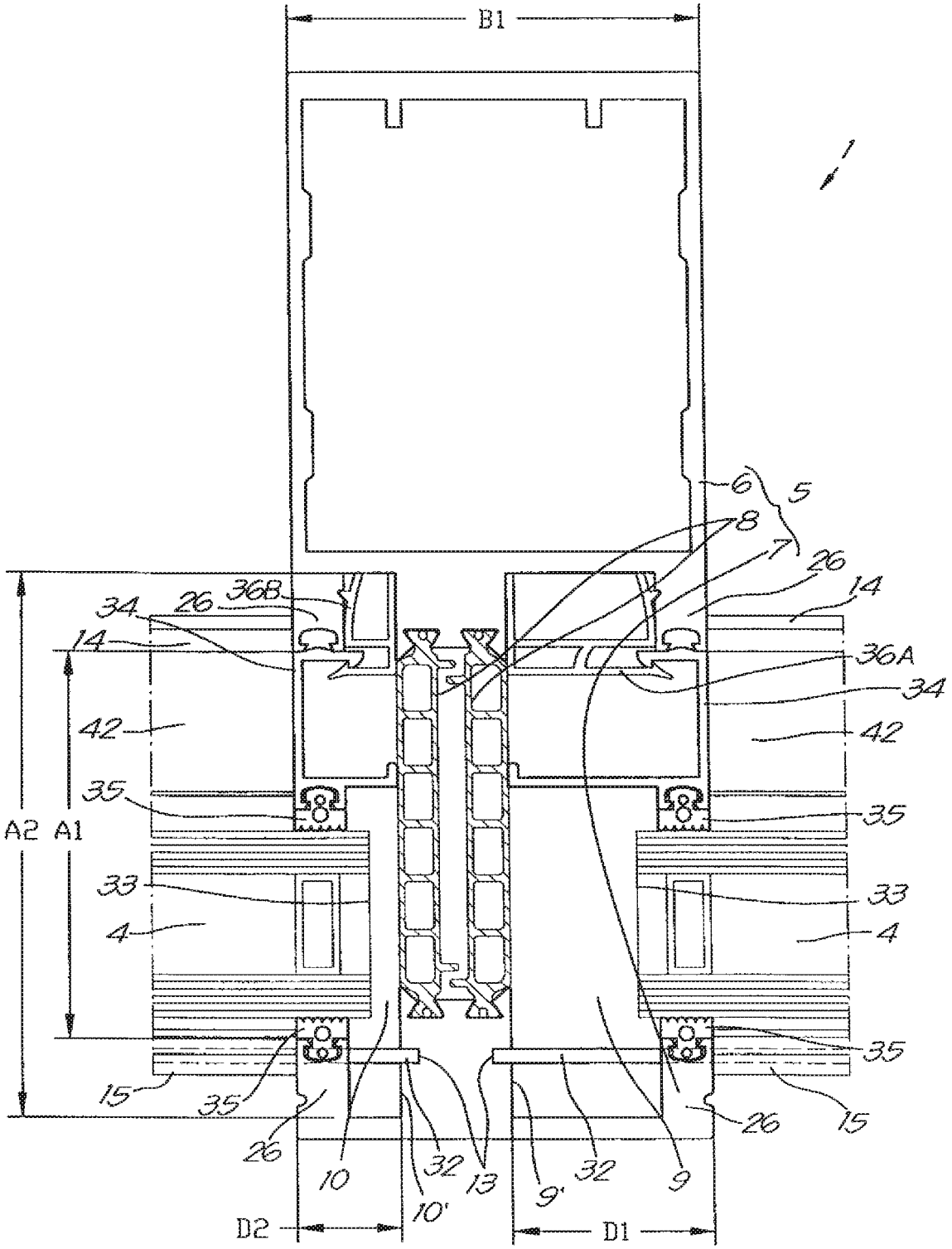

The mullion profiles 5 have a lateral undercut groove on both sides, namely a deep lateral groove 9 on one side, in FIGS. 2 and 3 on the right side, and a shallow groove 10 on the other side. The deep lateral groove 9 has a depth D1 of 28 mm, and the shallow lateral groove 9 has a depth D2 of 14 mm.

Both grooves 9 and 10 serve as a rabbet 11 for the side edges of the panels 4. The access opening 12 of the lateral grooves 9, 10 has a horizontal dimension, which is 54 mm wide. The maximum horizontal dimension A2 of the lateral grooves 9, 10 is approximately 76 mm.

The sub-profiles 6, 7 and 8 of the mullion profiles 5 are inseparably connected to each other, which means that they cannot be uncoupled from each other without causing irreversible damage. This means that the grooves 9 and 10 cannot be opened without damage and thus that the width A1 of the access opening 12 is a fixed size. At the bottom 9' and 10' of the two lateral grooves 9, a narrow second groove 13 is provided.

The transoms 3 are mainly formed by transom profiles 14 onto which an aluminium glazing beads 15 are attached to the outside of the curtain wall 1. The transom profiles 14 are shown separately in a cross-sectional view in FIG. 8.

The transom profiles 14 are Z-shaped profiles, having a first vertical leg 16 on the inside, a second vertical leg 17 on the outside and a section 18 between both legs 16, 17.

The transom profiles 14 have a total height H1 of 56 mm and a horizontal dimension A3 of 64 mm.

Figure 8:
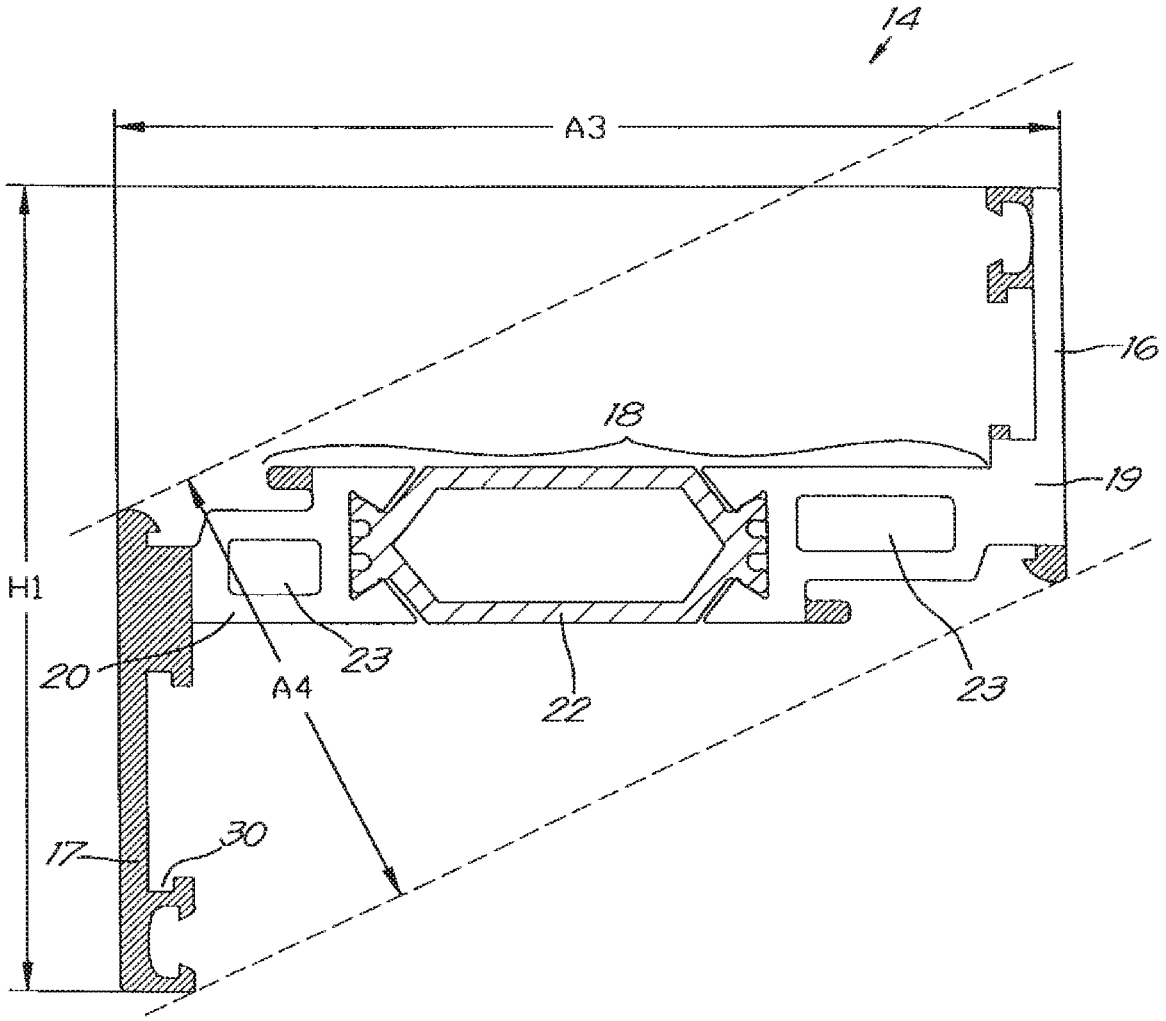
FIG. 8 schematically represents a part of the curtain wall of FIG. 1 and shows a step in the manufacturing process of the curtain wall of FIG. 1.

It is important to note that in a slanting direction, deviating approximately 60° from the horizontal direction, the transom profiles 14 have a much smaller dimension A4 of about 34 mm as shown in FIG. 8.

The transom profiles 14 consist of three sub-profiles, namely an aluminium inner sub-profile 19, a portion of which forms the first leg 16, an aluminium outer sub-profile 20, a portion of which forms the second leg 17 and a plastic insulation profile 22. These three sub-profiles 19, 20, 22 are firmly attached to each other by means of rolling, i.e. mechanical deformation of lips on the aluminium sub-profiles 19, 20 in order to clamp the plastic profiles 22.

The inner and outer section profiles 19, 20 are each provided with an internal chamber 23.

Figure 4:
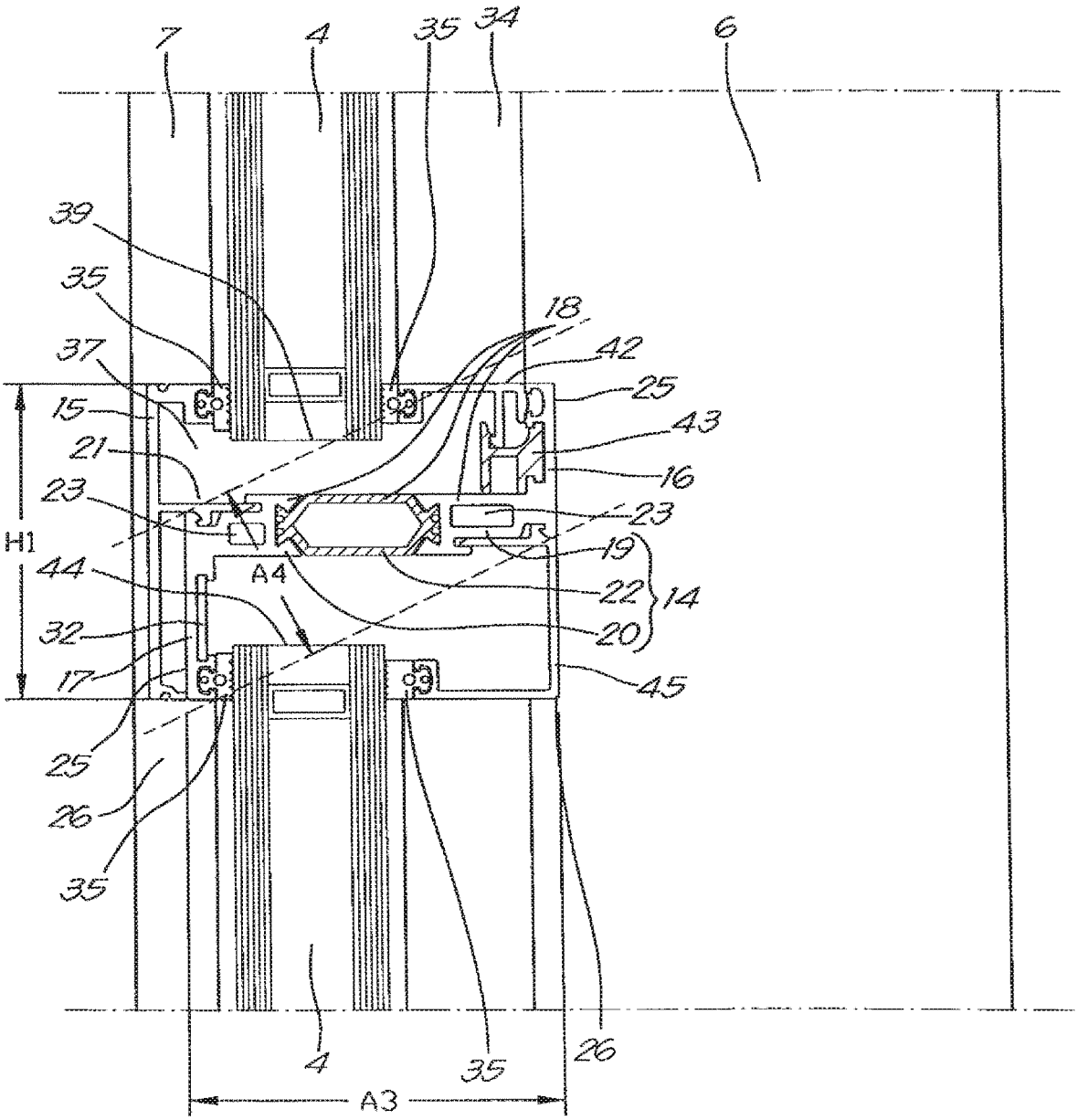
FIG. 4 schematically represents a cross-section of the curtain wall of FIG. 1 along line IV-IV.
Figure 5:
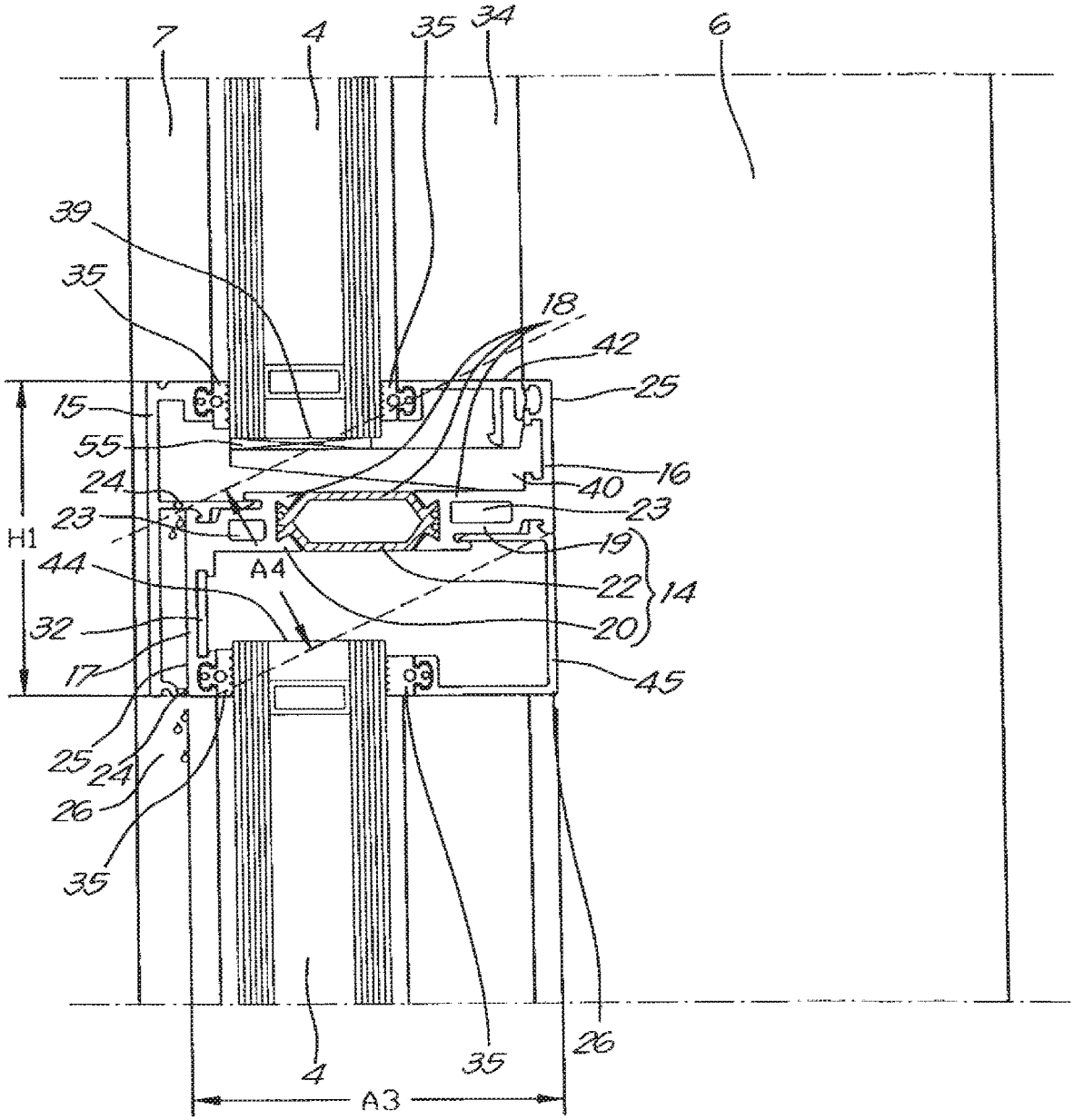

As illustrated in FIG. 4, the glazing beads 15 are provided with clipping parts 21 or other fastenings in order to attach them to the transom profiles 14, for example against the vertical leg 17 on the outside of the curtain wall 1.

Figure 5:
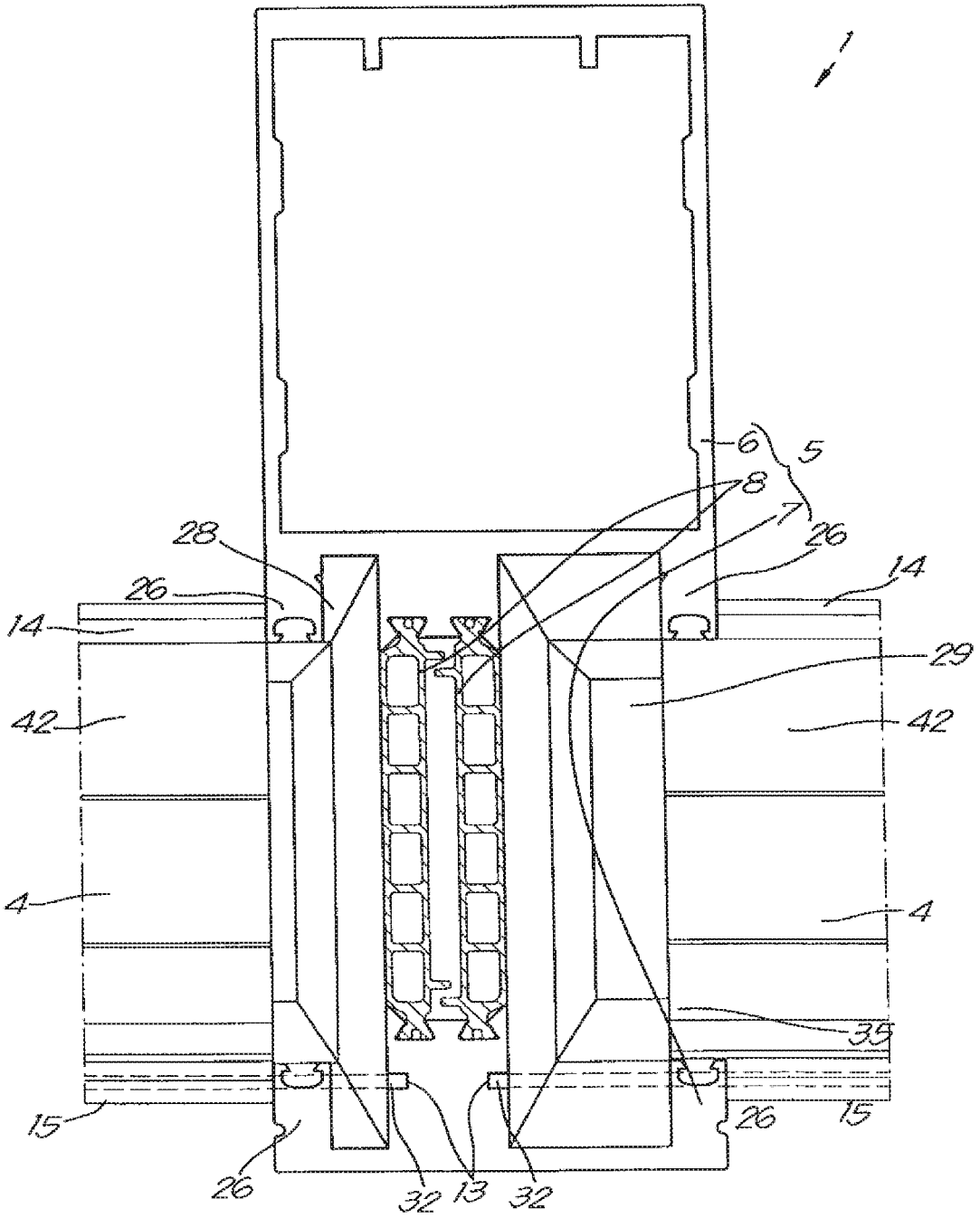
FIG. 5 schematically represents a cross-section of the curtain wall of FIG. 1 along line V-V.

As is particularly apparent from FIG. 5, the glazing beads 15 are provided with water drainage openings 24 at a small distance from the mullion profiles 5. Such drainage openings 24 may additionally also be provided in one or more other locations in the glazing beads 15. This depends on the length of the transoms 3.

Figure 7:
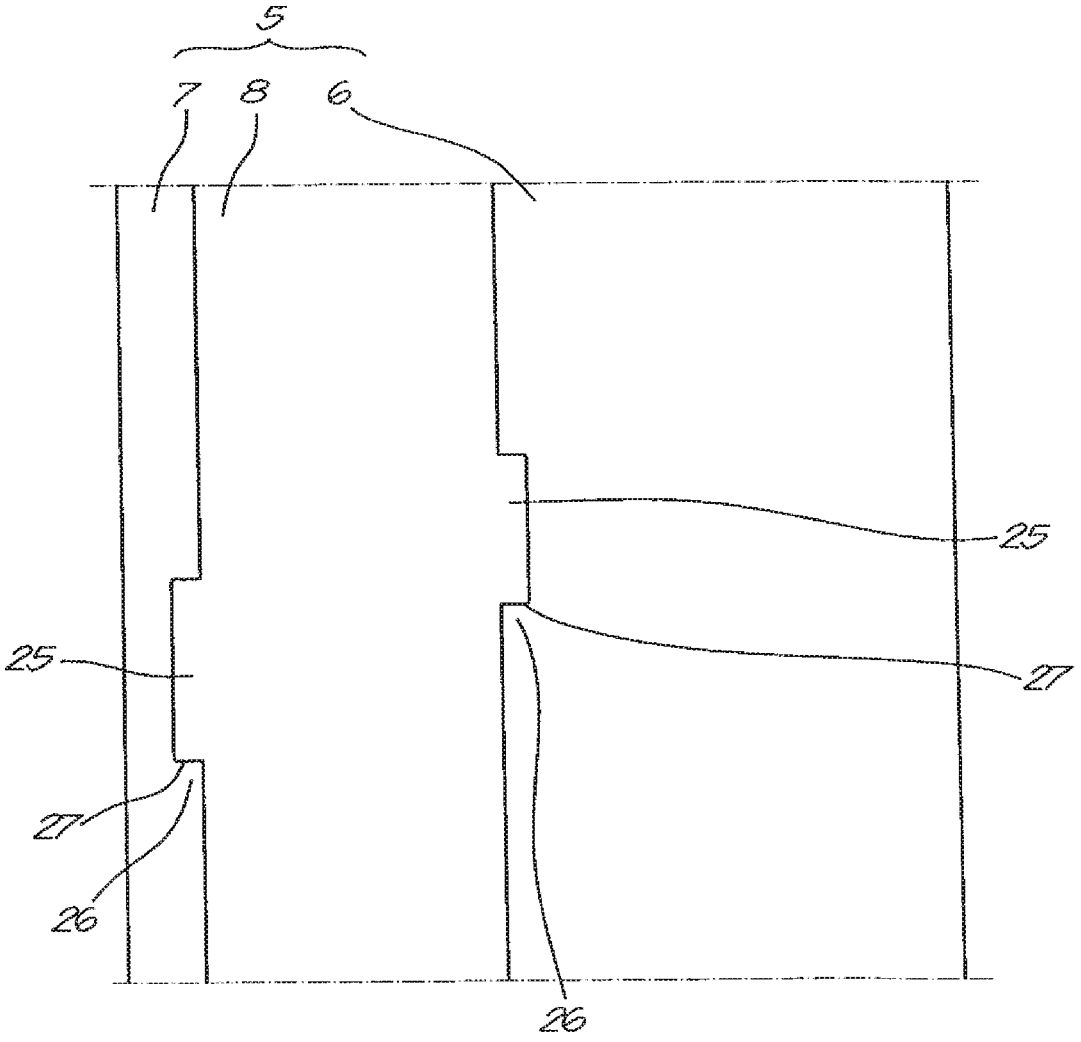
FIG. 7 schematically represents the result of the step of FIG. 6 in a view according to F7.
Figure 11:
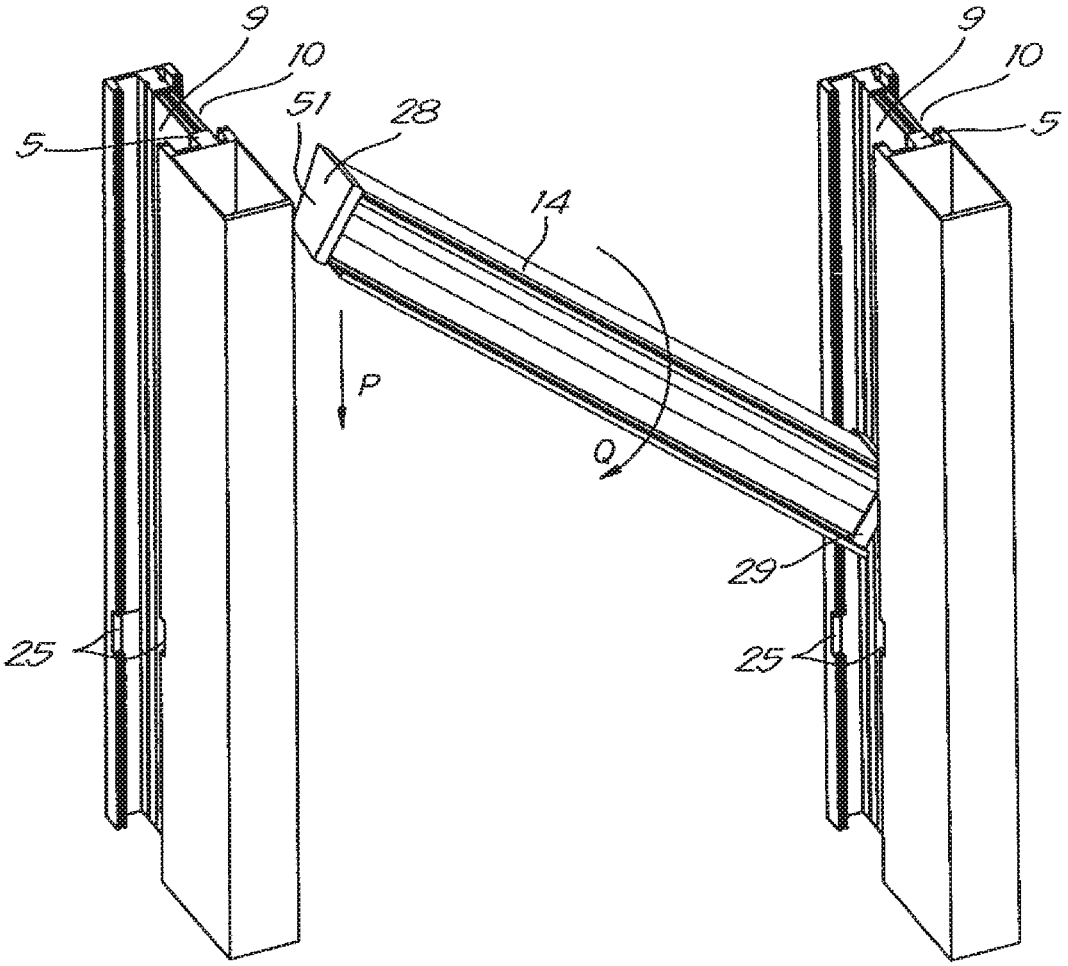
FIG. 11 schematically shows a next step in the manufacturing process of the curtain wall of FIG. 1 in perspective.

The transom profiles 14 are attached to the mullion profiles 5 because parts of the transom profiles 14, and more specifically the first and second legs 16, 17, rest in the recesses 25 shown in FIGS. 7 and 11 in the walls 26 of the lateral grooves 9, 10 of the mullion profiles and are vertically supported by the bottom edge 27 of these recesses 25. How this is achieved will be explained later.

At the ends of the transom profiles 14, sealing pieces 28, 29 are provided that are made of rubber with a Shore hardness of 75. These sealing pieces 28, 29 fit exactly into the lateral grooves 9, 10 of the mullion profiles and seal these grooves 9, 10 off in the vertical direction to prevent possible infiltration water coming into grooves 9 and 10 and constitute as such a vertical barrier, so that the water cannot possibly pass through to an underlying module—the so-called waterfall principle or cascade drain, but possible infiltrated water is individually drained from each panel (or facade plane) separately.

The transom profiles 14 are preferably equipped to drain this water to the outside of the curtain wall 1, with the upper side of the transom profile 14 slanting downwards to the outside of the curtain wall 1, for example.

Figure 9:
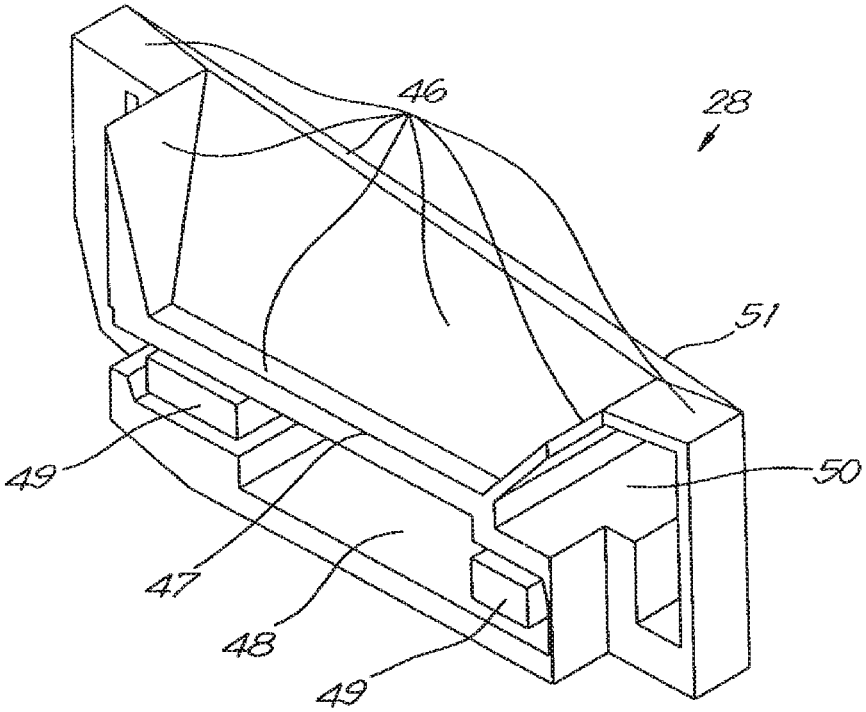
FIGS. 9 and 10 schematically show parts of the curtain wall of FIG. 1 in perspective.
Figure 10:
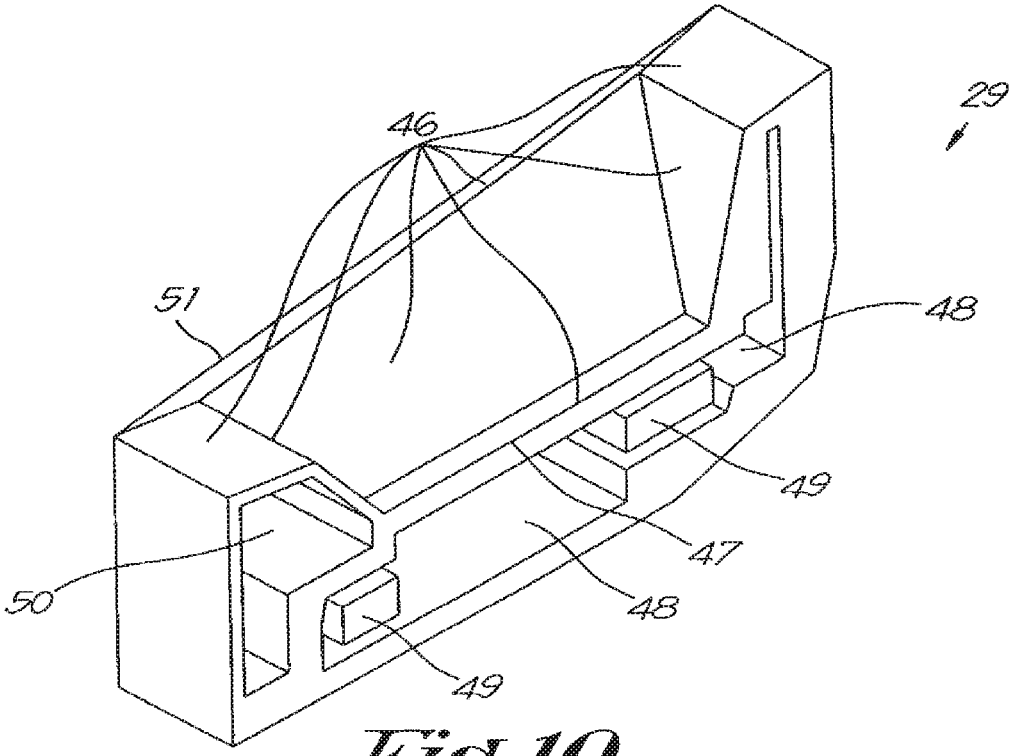

The raised leg 16 on the inside of the curtain wall prevents water from infiltrating to the inside. Details of these sealing pieces 28, 29 and the manner in which they are attached to the transom profiles 14 will be addressed later. These sealing pieces 28 and 29 are shown in FIGS. 3, 9 and 10 and are preferably manufactured in a single piece by injection moulding or the like.

In order to secure the attachment of the transom profiles 14 to the mullion profiles 5, the transom profiles 14 on the inside of the second leg 17 are provided with an undercut groove 30. At one or both ends of this undercut groove 30 is a rod, in this example an aluminium slat 32 mounted in the groove 30 so that it can be slid in the groove. When mounted, the slat 32 extends beyond the undercut groove 30 with a protruding end, said end is fitted in a second groove 13 of the mullion profiles 5 and acts as a lock.

Due to the fact that the groove 30 and the slat 32 are located on the inside of the outer vertical leg 17 of a transom profile 14, the transom profile 14, in its end position, can be locked from the inside during the construction of the curtain wall 1 by sliding slat 32 from a groove 30 into a groove 13 of a mullion profile 5.

The side edges 33 of the glass panels 4 are secured in the lateral grooves 9, 10 of the mullion profiles 5 by being fitted between the outer profile 7 of the mullion profiles 5 and the vertical glazing beads 34 on the inside of curtain wall 1. In this setup, rubber gaskets are placed between the outer profile 7 and the glass panels 4, and between the vertical glazing beads 34 and the glass panels.

Glazing beads are profiles made out of a rigid material and which serve with the aid of a gasket to accommodate the play between the thickness of the panels 4 and the width A1 of the rabbet 11 or rather: to accommodate the differences in thickness between thicker or thinner panels. These glazing beads have a width that has to be adjusted to the thickness of the panels that are to be installed.

The vertical glazing beads 34 are attached to the mullion profiles 5 by means of first attachment aids 36, used in two variants, namely a first variant 36A for use in the deep lateral groove 9 and a second variant 36B for use in the shallow lateral groove 10.

These first attachment aids 36 are PVC profiles with a profile length of approximately 3 cm. At a distance of approximately 60 cm, they are snapped onto the mullion profiles 5 and the vertical glazing beads 34 are in turn snapped onto the first attachment aids 36.

The glazing beads 15 protrude to a certain height above the section 18 of the transom profiles 14 and together with the upwardly directed leg 16 of the transom profiles 14, they form a rabbet 37 for the lower edge 39 of an upper glass panel 4.

The lower edge 39 of the glass panels 4 is supported by glass supports 40 that are attached to the first leg 16 of the transom profiles 14, near the mullion profiles 5, as shown in FIG. 5.

The lower edge 39 of the glass panels 4 is fitted between the glazing beads 15 on the outside of the curtain wall 1 and a horizontal glazing bead 42 on the inside. There are rubber gaskets 35 inserted between the glazing beads and the glass panels 4 and between the horizontal glazing beads 42 and the glass panels 4, as shown in FIG. 4.

The horizontal glazing beads 42 are attached to the transom profile 14 by means of second attachment aids 43 on the inside of the curtain wall 1 as shown in FIG. 4.

These second attachment aids 43 are PVC profiles with a profile length of approximately 3 cm. They are attached to the transom profiles 14 at intervals of about 60 cm and the horizontal glazing beads 42 are snapped onto the second attachment aids 43.

The upper edge 44 of the glass panels 4 is fitted between the glazing beads 15 on the outside of the curtain wall 1 and another horizontal glazing bead 45 on the inside which is provided with a rubber gasket 35 and which is snapped directly onto the transom profile 14.

It is noted that in some figures parts have been omitted to make other parts more visible. This is especially true of FIGS. 2 and 3, where in FIG. 2 mainly the sealing pieces 28, 29 and the ends of the transom profiles 14 are omitted, and in FIG. 3, mainly the glass panels 4, the vertical glazing beads 34 and the first attachment aids 36 for the vertical glazing beads 34 are omitted.

The manufacture and construction of the curtain wall 1 as described above is as follows.

First, the mullion profiles 5 and transom profiles 14 are prepared. At the positions where the transom profiles 14 are to be connected to the mullion profiles, the mullion profiles are provided with recesses 25, especially in the walls 26 defining the access opening 12 of the lateral grooves 9, 10. This is shown by means of shading in FIG. 6, which indicates where material of the mullion profiles 5 is removed, for example by milling. The obtained result is shown in FIG. 7.

The transom profiles 14 are also prepared. At their ends, a part of the transom profile 14 is milled for a length of about 11 mm. Shading indicates this part in FIG. 8.

These steps are normally, but not necessarily, automated and performed in a specialized workshop before the profiles 5,14 are transported to the location where the curtain wall 1 is to be built.

Next, the required glass supports 40 and second attachment aids 43 are provided in a groove routed for this purpose in the first leg 16.

Subsequently, sealing pieces 28, 29 are slid on the ends. These are shown in FIGS. 9 and 10 and exist in two variants, i.e. a first variant 28 as shown in FIG. 9, to be placed on the end of a transom profile 14 intended to be fitted into the shallow lateral groove 10 of the mullion profiles 5 and a second variant 29, as shown in FIG. 10, to be placed on the end of a transom profile 14 intended to be fitted in the deep lateral groove 9 of the mullion profiles 5.

The pre-assembled sealing pieces 28, 29 attached to the transoms both have an upper surface 46 formed from planes slanting to a lowest point 47 away from the bottom 9' or 10', respectively of the grooves 9 and 10 in which the sealing pieces 28, 29 are fitted. Also, both sealing pieces 28, 29 have a recess 48 for receiving the ends of the transom profiles 14 with two ridges 49 with corresponding positions and formats relative to the chambers 23 in the transom profiles 14.

These recesses 48 do not fully extend through the sealing pieces 28, 29. The walls 51 perpendicular to the transom profiles 14, i.e. the rear walls in FIGS. 9 and 10, are completely closed. The sealing pieces 28, 29 sealingly fit with these walls 51 against the bottom 9' and 10' of a groove 9 or 10 in which they have been mounted.

In top view, the sealing pieces 28, 29 are sized to fit precisely in the lateral grooves 9, 10.

Both sealing pieces 28, 29 are also provided with air chambers 50, wherein at the position of the air chambers 50, the outer wall is relatively thin so that the air chambers 50 are deformable.

The sealing pieces 28 according to the first variant are fixed permanently onto the transom profiles 14, for example by means of glue. The sealing pieces 29 of the second variant are slid onto the transom profiles 14 and are not secured further onto the transom profiles 14.

Then a previously mentioned aluminium slat 32 is fitted into the undercut groove 30 of the second leg 17 at both ends of the transom profiles 14.

Next, the mullion profiles 5 are mounted in their desired position.

Hereafter, the transom profiles 14, in an orientation in which they are rotated about 60° on their longitudinal axis and in which they are not horizontal, are held in the plane defined by the mullion profiles 14, as shown in FIG. 11.

The transom profiles 14 are now brought to a horizontal orientation, as indicated by arrow P, with the ends being inserted into the lateral grooves 9, 10 of the mullion profiles 5. Due to the direction of rotation of the transom profiles 14, rotated around their profile direction, these ends easily fit in the access openings 12 of these lateral grooves 9, 10.

Then the transom profiles 14 are moved downwardly until they are in their desired position, i.e. at the recesses in the mullion profiles 5. Then the transom profiles 14 are rotated as indicated by arrow Q. The situation as shown in FIG. 12 is now reached.

Figure 12:
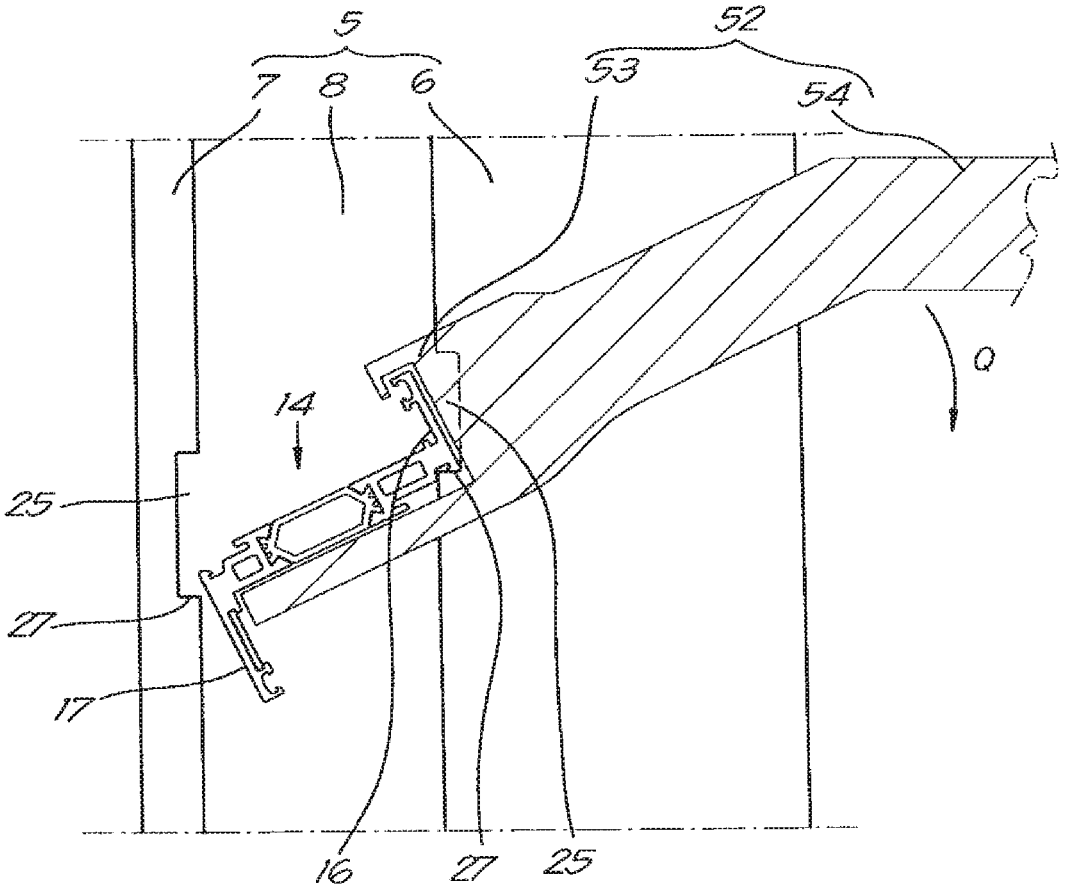
FIG. 12 schematically represents in cross-section analogous to FIG. 5 a next step in the manufacturing process of the curtain wall of FIG. 1.

The transom profiles 14 need to be rotated even further, starting from the situation as shown in FIG. 12. Because this requires relatively much force, preferably a tool 52 is used. This is a tool 52 with a head 53 with a partially complementary shape to the transom profile 14 and a lever 54 attached to the head 53. The lever 54 of the tool 52 is moved in the direction of arrow Q until the transom profile 14, as shown in FIGS. 4 and 5, is positioned in its end orientation in the recesses 25.

The sealing pieces 28, 29, more specifically their air chambers 50, deform considerably during this operation, but resume their original shape when the transom profile 14 is in its final orientation. The sealing pieces 28, 29 hereby completely close the lateral grooves 9, 10 in the vertical direction.

Next, the glazing beads 15 are attached with the gaskets to the sub-profile 20 of the transom profiles 14 on the outside of the curtain wall. This can easily be done from the inside of the curtain wall using the clips 21.

Figure 13:
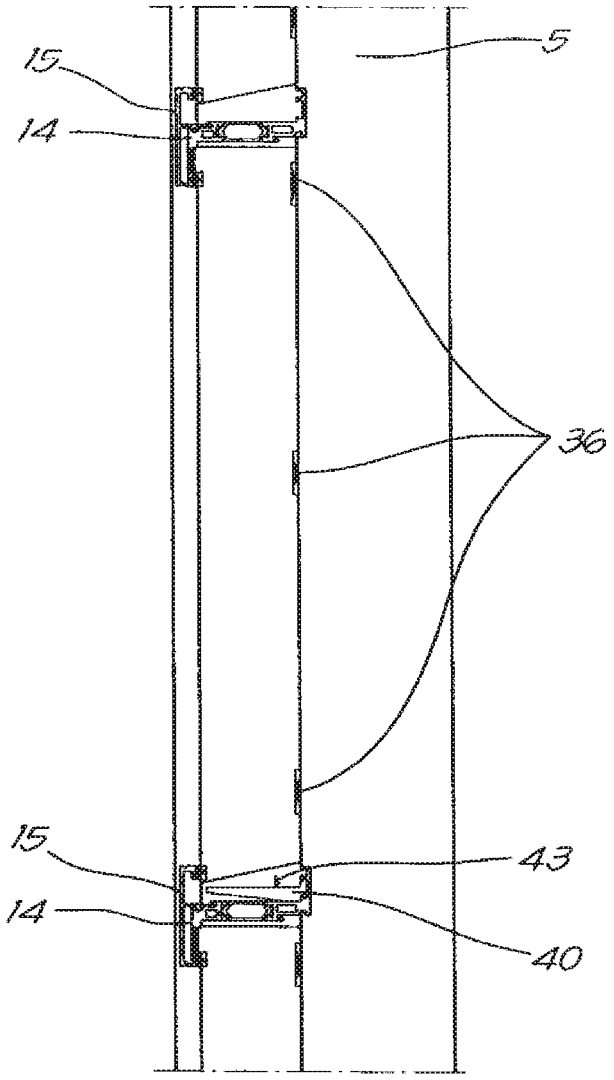
FIGS. 13 and 14 schematically represent in side view, and top view respectively, a next step in the manufacturing procedure of the curtain wall of FIG. 1, and FIGS. 15 and 16, schematically represent in side view, and top view respectively, a next step in the manufacturing procedure of the curtain wall of FIG. 1.
Figure 14:
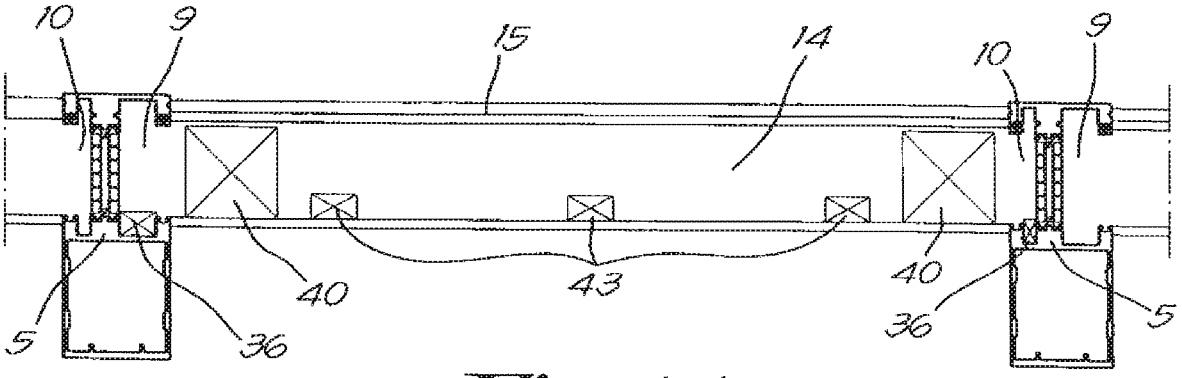

The glass supports 40 are pushed into their desired place, i.e. about 20 mm from the mullion profiles 5, and second attachment aids 43 are shifted until they are spread out over the length of the transom profiles 14, and the first attachment aids 36 for the vertical glazing beads 34 are snapped into their place as shown schematically in FIGS. 13 and 14.

The glass frame are already provided with rubber gaskets and neoprene blocks 55 are glued onto the glass supports 46, as shown in FIG. 5.

The slats 32 in the undercut grooves are pushed outwardly until they slide with an end into the second groove 13. They are then fixed in that position, for example with a little glue or by a screw. The transom profiles 14 can now no longer separate from the mullion profiles 5.

The construction can now be provided with glass panels 4.

Figure 15:
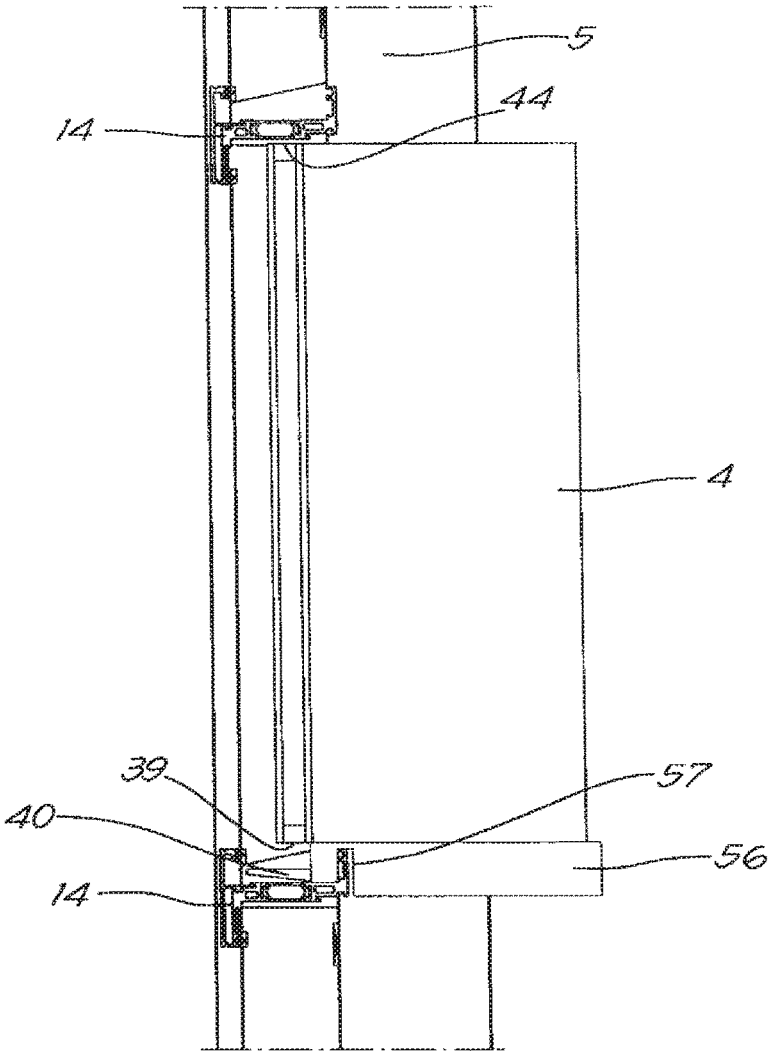
Figure 16:
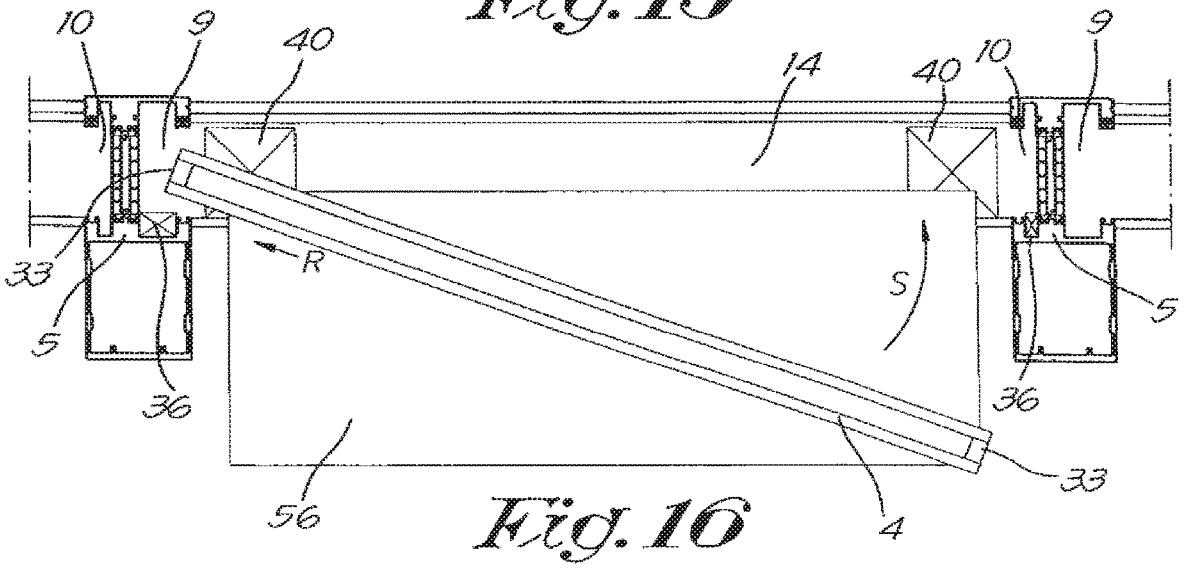

First, a wooden block 56 with a recess 57 for the first leg 16 is temporarily placed over the first leg 16. On top of this a glass panel 4 is placed in a slanted orientation. This is illustrated in FIGS. 15 and 16. The side edge 33 of the glass panel 4 that fits in the deep lateral groove 9 is now shuffled into this lateral groove 9 as indicated by arrow R.

Next, the other side edge 33 is shuffled along the opposite mullion section 5 as indicated by arrow S. To this end, the depth D1 of the groove 9 must be sufficient to shuffle the glass panel 4 sufficiently deep into this groove 9 with a pivotal movement of the glass panel 4 towards the shallow groove 10 and to then shuffle the glass panel 4 to the right, so that the glass panel 4 fits with both side edges 33 about 10 mm into a groove 9 or 10.

Then the glass panel 4 is centered so that it fits approximately 10 mm into both lateral grooves 9, 10 and then it is lowered onto the neoprene blocks 55. The wooden block 56 can now be removed.

Next, the horizontal and vertical glazing beads 34, 42, and their gaskets 35 can be applied. The glazing beads 34, 42, 45 can simply be snapped into place along the inside of the curtain wall 1. At the upper horizontal glazing bead 45, this is done directly onto the transom profile 14. The lower horizontal glazing bead 42 is snapped onto the second attachment aids 43 and through this onto the transom profile 14. The vertical glazing beads 34 are snapped onto the first attachment aids 36 and through this onto the mullion profile 4.

Now the final curtain wall 1, as shown in FIGS. 1 to 5, is built.

It is noted that, outside of the parts where the glass supports 40 are attached and located just next to the mullion profiles 5, the transom profiles 14 have no bearing function for the glass panels 4.

If water reaches the horizontal gaskets 35 on the outside, this water is diverted to the outside through the drainage openings 24 into the glass frames 15 as shown in FIG. 5. If water gets to the vertical gaskets into the lateral grooves 9, 10, it is diverted via the upper surfaces 46 of the sealing pieces 28 and 29 to the transom profiles 14 and from there it is drained to the outside via the drain openings 24 in the glass frames 15.

If wind or other causes engender slight deformations of the curtain wall 1, the transom profiles 14 can slide a few millimetres into the sealing pieces 29 according to the second variant, which causes less stress to the curtain wall 1. Movements and deformation can also be absorbed by rubber sealing pieces 28 and 29 without jeopardizing the waterproofness of the curtain wall 1.

Although the construction method described above is done from the inside, it is also possible from the outside, although an installation from the inside usually has advantages.

The present invention is by no means limited to the embodiment described as an example and shown in the drawings, but a curtain wall according to the invention can be realized in all kinds of variants, without departing from the scope of the invention, as defined by the claims.

The invention claimed is:

1. A curtain wall comprising one or more mullion profiles and one or more transom profiles and panels that fit with edges into the mullion profiles and into the transom profiles, wherein the one or more mullion profiles extend vertically and are provided with a lateral undercut groove with a fixed width access opening on two opposite sides and at least one horizontal recess for receiving a transom profile, said lateral undercut grooves forming a rabbet in which the edge of said panel is fitted, each of said fixed width access openings having a width smaller than a width of the lateral undercut groove, wherein the one or more transom profiles comprise a first end and a second end and sealing pieces provided on said first and second ends, has a length greater than a horizontal distance between two adjacent mullion profiles to extend horizontally between said two adjacent mullion profiles, and are fitted with the first and second ends in the lateral undercut grooves of the two mullion profiles in a way such that the one or more mullion profiles and the one or more transom profiles are configured so that the one or more transom profiles is able to be brought horizontally and then rotated in the lateral undercut grooves and in the at least one horizontal recess for positioning of the same, the sealing pieces forming a barrier for water, wherein the barrier is adapted to divert the water to said transom profile and wherein the transom profiles are adapted to drain the water to outside of the curtain wall.

2. The curtain wall of claim 1, wherein the transom profiles are designed to drain said water to the outside of the curtain wall because the transom profiles are provided with drainage openings for water, said drainage openings being located at a distance from the mullion profiles.

3. The curtain wall of claim 1, wherein the transom profiles are configured in such a way that the section of the transom profiles to which said water is diverted, is horizontal or slopes to the outside.

4. The curtain wall of claim 1, wherein the sealing pieces are flexible plastic or rubber sealing pieces at connection points between the transom profiles and the mullion profiles, shapes of the mullion profiles and the sealing pieces being adapted to each other, wherein the sealing pieces are arranged on the ends of the transom profiles.

5. The curtain wall of claim 4, wherein each of the sealing pieces is made in one piece.

6. The curtain wall of claim 4, wherein the sealing piece is provided at each of the two ends of the transom profiles, wherein at least one of the sealing pieces of the transom profile is slidable on the transom profile in order to accommodate small movements.

7. The curtain wall of claim 6, wherein the other sealing piece is fixed permanently on the transom profile.

8. The curtain wall of claim 4, wherein the sealing pieces are provided with two or more ridges, wherein the transom profiles are provided with two or more chambers, wherein the position and size of the ridges and the chambers are adapted to each other in such a way that the ridges fit into the chambers.

9. The curtain wall of claim 4, wherein the sealing pieces comprise a flat end wall that is perpendicular to the profile direction of the transom profiles, wherein the end wall is completely closed in the profile direction of the transom profiles and the end wall is resting against the bottom of a groove of a mullion profile.

10. The curtain wall of claim 1, wherein the mullion profiles and the transom profiles are composite profiles, each being composed of two or more sub-profiles, wherein the sub-profiles are not made of the same material.

11. The curtain wall of claim 1, wherein the walls of the undercut grooves of the mullion profiles are inseparably connected to each other.

12. The curtain wall of claim 1, wherein at least one of the lateral undercut grooves has a depth and is configured to allow a panel to be first laterally inserted with one side edge in the at least one lateral undercut groove so as to subsequently permit to align the panel with its other side edge in front of the other groove by rotation.

13. The curtain wall of claim 1, wherein the transom profiles are formed by a Z-shaped profile with an upwardly directed leg on the inside and a downwardly directed leg on the outside which are connected to each other by a horizontal or slightly outwardly draining section.

14. The curtain wall of claim 13, wherein the transom profiles are provided with a glass frame that can be mounted from the inside of the curtain wall and wherein, together with the upwardly directed leg forms a rabbet for the lower edge of an upper panel.

15. The curtain wall of claim 13, wherein the mullion profiles and the transom profiles on the inside of the curtain wall are provided with glazing beads to secure the panels from the inside.

16. The curtain wall of claim 1, wherein the lateral undercut grooves have different depths.

17. The curtain wall of claim 1, wherein the sealing pieces are dimensioned to fully enclose at least one of the first end or the second end of the one or more transom profiles.

18. The curtain wall of claim 1, wherein the sealing pieces form a vertical barrier for water in the at least one or more mullion profiles.

19. The curtain wall of claim 1, wherein no screws are used for connecting the one or more transom profiles and the one or more mullion profiles to each other.

20. The curtain wall of claim 1, wherein the curtain wall is configured in a way such that the curtain wall is able to be built completely from an inside of a building to which the curtain wall is attached.

* * * * *